US006459184B1

(12) United States Patent
Ozeki

(10) Patent No.: US 6,459,184 B1
(45) Date of Patent: Oct. 1, 2002

(54) ERGOMETER LOADING DEVICE WITH LARGE BRAKING FORCE

(75) Inventor: Tsunemitsu Ozeki, Kobe (JP)

(73) Assignee: Cateye Co., Ltd., Osaka (JP)

( * ) Notice: Subject to any disclaimer, the term of this patent is extended or adjusted under 35 U.S.C. 154(b) by 0 days.

(21) Appl. No.: 09/520,475

(22) Filed: Mar. 8, 2000

(30) Foreign Application Priority Data

Mar. 9, 1999 (JP) ..... 11-061833

(51) Int. Cl.[7] ..... H02P 15/00

(52) U.S. Cl. ..... 310/93; 310/105; 118/267; 482/2

(58) Field of Search ..... 310/74, 93, 92, 310/77, 102 R, 105, 106, 264, 267; 188/161, 164, 267; 482/2, 63, 103

(56) References Cited

U.S. PATENT DOCUMENTS

| | | | | | |
|---|---|---|---|---|---|
| 4,084,810 | A | * | 4/1978 | Forsman | 188/159 |
| 4,398,111 | A | * | 8/1983 | Zuch | 310/93 |
| 4,452,445 | A | * | 6/1984 | Csekes | 310/75 B |
| 4,517,505 | A | * | 5/1985 | Cunningham | 318/611 |
| 4,713,567 | A | * | 12/1987 | Fey et al. | 188/164 |
| 4,775,145 | A | * | 10/1988 | Tsuyama | 482/63 |
| 4,800,310 | A | * | 1/1989 | Nakao et al. | 310/105 |
| 4,853,573 | A | * | 8/1989 | Wolcott et al. | 310/105 |
| 5,042,794 | A | * | 8/1991 | Sun | 482/5 |
| 5,236,069 | A | * | 8/1993 | Peng | 188/267 |
| 5,586,624 | A | * | 12/1996 | Ko et al. | 188/164 |
| 6,084,325 | A | * | 7/2000 | Hsu | 310/74 |
| 6,200,426 | B1 | * | 3/2001 | Graf | 162/262 |

FOREIGN PATENT DOCUMENTS

| | | | | |
|---|---|---|---|---|
| CH | 673361 | * | 2/1990 | |
| DE | 2221005 | | 11/1973 | |
| DE | 9210159.3 | | 11/1992 | |
| EP | 0193286 | | 9/1986 | |
| FR | 2275926 | * | 2/1976 | |
| GB | 2242 075 | | 9/1991 | |
| JP | 1-25310 | | 1/1985 | H02K/49/02 |
| JP | 63-50952 | | 1/1985 | H02K/49/02 |
| JP | 2-45905 | | 10/1990 | A63B/22/06 |
| JP | 06-261494 | * | 9/1994 | |

* cited by examiner

*Primary Examiner*—Joseph Waks
(74) *Attorney, Agent, or Firm*—Olson & Hierl, Ltd.

(57) ABSTRACT

An ergometer loading device includes a rotor and a stator which is provided so as to be coaxial with the rotor and have a prescribed gap from the rotor. The stator is provided with a core and a plurality of exciting coils. The rotor includes a ferromagnetic body such as a steel plate and a conductor of small electric resistance provided on the ferromagnetic body. Since the conductor faces the core of the stator with the prescribed gap therebetween, an ergometer loading device which is adjusted easily and applies large torque can be provided.

4 Claims, 6 Drawing Sheets

ERGOMETER LOADING DEVICE WITH LARGE BRAKING FORCE

BACKGROUND OF THE INVENTION

1. Field of the Invention

The present invention relates to ergometer loading devices, and more particularly to an ergometer loading device with large braking force.

2. Description of the Background Art

An ergometer loading device of interest to the present invention is disclosed, for example, in Japanese Patent Publication No. 2-45905.

FIG. 6 is a block diagram which shows a main part of a bicycle ergometer disclosed in the publication. Referring to FIG. 6, the loading device of the bicycle ergometer includes a loading portion 50 to apply a load to a rider, and a control portion 60 to control loading portion 50. Loading portion 50 includes a load shaft 51 rotated when the rider presses down a pedal, a wheel 52 fixed on load shaft 51, and an annular disk 53 of a copper plate, for example, provided on the circumference of wheel 52. In order to facilitate rotation of disc 53, that is, wheel 52, an annular weight ring 54 having a flywheel function is attached to a linkage portion between wheel 52 and disk 53.

In connection with disk 53, only one electromagnet 57 is provided and fixed to a frame 58. Electromagnet 57 is formed of a core 55 and an exciting coil 56 which is wound around core 55 by means of a coil bobbin, not shown. Core 55, which is a C-shaped core having one opening, is provided to sandwich, in a non-contact manner, the both main surfaces of disk 53 between the opening end surfaces.

Exciting coil 56 has its one end terminal connected to a direct voltage source $V_D$ and its other terminal is connected to ground via a control transistor 61 and a resistor 62. The base of control transistor 61 is supplied with an output of a comparator 63. Control transistor 61, resistor 62, comparator 63, a CPU described below, and the like form control portion 60 and carry out a control operation so that a current, which is set, is supplied to exciting coil 56.

The setting of the current to be supplied to exciting coil 56 is controlled through a key board 66 provided for a control panel, not shown, CPU 65, a display 67 and a D/A conversion circuit 64 as described below. A user enters desired braking torque (a load of the ergometer according to the user's athletic ability) by using key board 66. The entered braking torque is displayed on display 67 through CPU 65 and can be checked. When the braking torque is determined, CPU 65 calculates an exciting current which is necessary to add the braking torque.

Another example of the conventional ergometer loading device will be shown in FIG. 7. Referring to FIG. 7, the example of the conventional ergometer does not employ a C-shaped core as shown in FIG. 6 but it includes a drum shape in which a rotor rotates around a stator. Referring to FIG. 7, an inner circumferential rotor 72 of a structural carbon steel pipe (STK or STKM) is fit in an outer circumferential rotor 71 made of gray cast iron. On an inner stator 73, six exciting coils 74 are provided opposite rotor 72. Exciting coils 74 are connected in series with each other and have their both ends connected to a power supply 75 provided outside. In this case, the controlling and the like of the ergometer are the same as in FIG. 6.

The conventional ergometer loading device is formed as described above. In the example shown in FIG. 6, the opening (the portion denoted by A in FIG. 6) of C-shaped core 55 is about 1.7 mm, and disk 53 which is formed of a copper plate with a thickness of 1 mm is inserted in the opening. Since the attachment portion of core 55 and the attachment shaft of the copper plate are different, adjustment operations are difficult to avoid contact between the copper plate and core 55. Since the copper plate has a thickness of 1 mm, it is easily deformed by small external force, and it takes time to make an adjustment to avoid contact with core 55.

In the structure in which the copper plate is inserted in the C-shaped core, the total gap of an air gap and a thickness of the copper plate is proportional to magnetic resistance, and thus the magnetic resistance of the gap increases as the total gap becomes larger.

Since the loading device shown in FIG. 7 has a drum shape and coaxially includes a rotor corresponding to the disk and a stator forming the core, it does not cause the problems as in FIG. 6. However, the loading device uses carbon steel (at most 0.12%) for outer circumferential rotor 71 and inner circumferential rotor 72. In other words, the ferromagnetic body is also used for the conductor. Therefore, the generated braking torque is small.

SUMMARY OF THE INVENTION

Therefore, one object of the present invention is to provide an ergometer loading device which is adjusted easily and applies large braking force.

Another object of the present invention is to provide an ergometer loading device which is inexpensive, adjusted easily and applies large braking force.

Still another object of the present invention is to provide an ergometer loading device which is adjusted more easily and applies larger braking force.

An ergometer loading device according to the present invention includes a rotor which has a steel plate and a member of small electric resistance provided on the steel plate and is rotatable about a prescribed shaft, and a stator which is coaxial with the rotor and faces the rotor with a prescribed gap therebetween, the stator including a plurality of exciting coils, and a member of small electric resistance faces the stator with a prescribed gap therebetween.

According to the present invention, the stator is provided which is coaxial with the rotor and faces the rotor with a prescribed gap therebetween, and the member of small electric resistance faces the stator with a prescribed gap therebetween. Therefore, an ergometer loading device which is adjusted easily and applies large braking force can be provided.

Preferably, the member of small electric resistance is plated with copper.

More preferably, the thickness of the plated copper is from 0.01 mm to 0.8 mm.

In another aspect of the present invention, an ergometer loading device includes a rotor which has a steel plate and a member of small electric resistance provided on the steel plate, and a stator which faces the rotor with a prescribed gap therebetween. The stator includes a plurality of exciting coils, and the member of small electric resistance faces the stator with a prescribed gap therebetween.

In the aspect of the present invention, the member of small electric resistance provided on the rotor faces the stator with a prescribed gap therebetween, and thus an ergometer loading device which is adjusted easily and applies large braking force can be provided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

In the following, the embodiments of the present invention will be described with reference to the drawings.

Figure 1B:
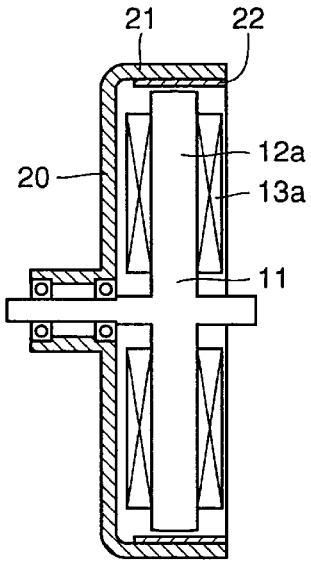
FIG. 1B is a side view of the outer drum type ergometer loading device.
Figure 1A:
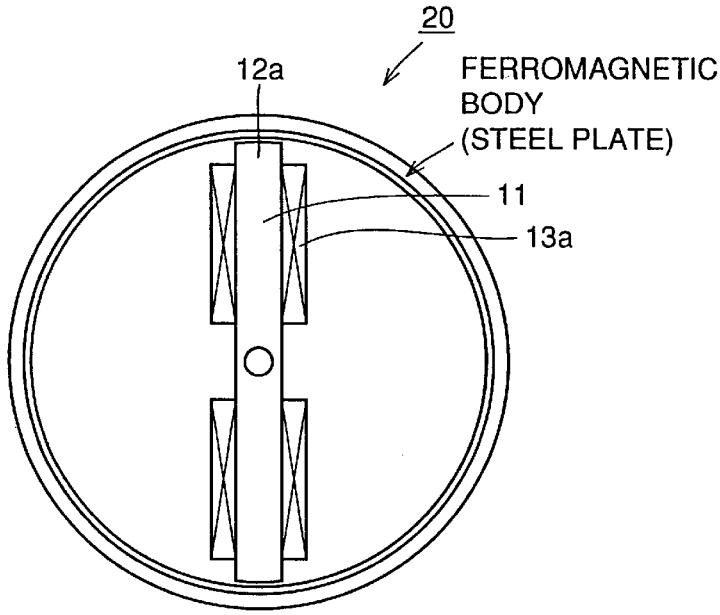
FIG. 1A is a front view of an outer drum type ergometer loading device, corresponding to the conventional one in FIG. 7.

Referring to FIGS. 1A and 1B, a loading device has an outer drum type structure in which a rotor 20 provided coaxially with a stator 11 rotates around stator 11. Stator 11 includes a core 12*a* and a coil 13*a*, and rotor 20 includes a ferromagnetic body 21 of a steel plate and a conductor 22. The gap between stator core 12 and rotor ferromagnetic body 21 is adjusted to about 1 mm.

Conductor 22 which is a material of small electric resistance is plated with copper and has a thickness of about 0.01 to 0.8 mm. It is economically effective especially when the thickness is about 0.01 to 0.1 mm.

Figure 2B:
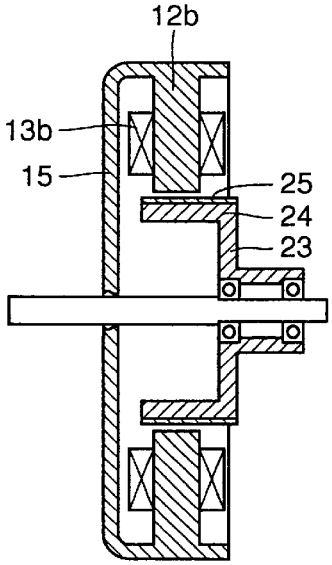
FIGS. 2A and 2B show a structure of an inner drum type loading device.
Figure 2A:
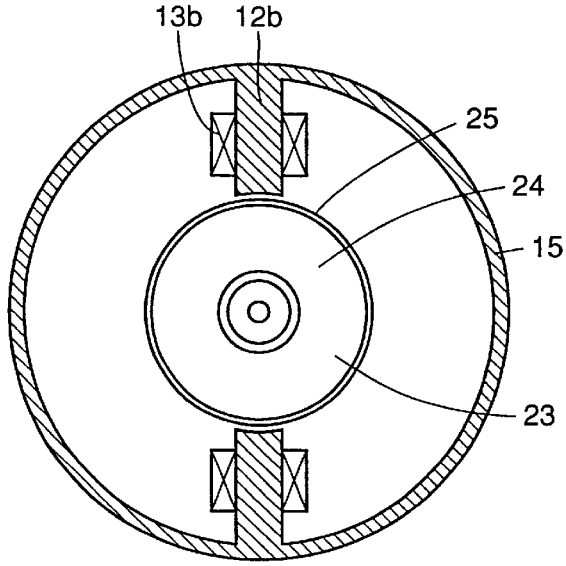

FIGS. 2A and 2B show the structure of an inner drum type loading device in which a stator is provided on the outer circumference and a rotor is provided on the inner circumference differently from FIGS. 1A and 1B. In the figures, FIGS. 2A and 2B are front and side views. For the inner drum type, a stator 15 is provided on the outer circumference of a rotor 23. Even in this case, rotor 23 which is formed of a ferromagnetic body 24 and a conductor 25 and stator 15 which is formed of a core 12*b* and a coil 13*b* has a gap similar to FIG. 1. Since rotor 23 and stator 15 are coaxial, the gap between rotor 23 and stator 15 can be adjusted easily. Since the rotor is formed of ferromagnetic body 21 and conductor 22 even in this case, braking torque becomes larger similarly to the embodiment shown in FIG. 1.

Figure 3A:
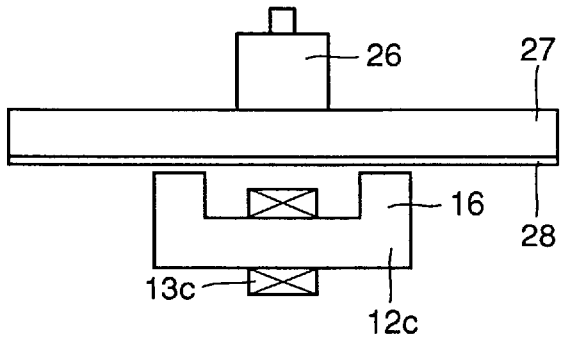
FIGS. 3A, 3B and 3C are plan, front and side views showing a structure of a core side surface type loading device.
Figure 3C:
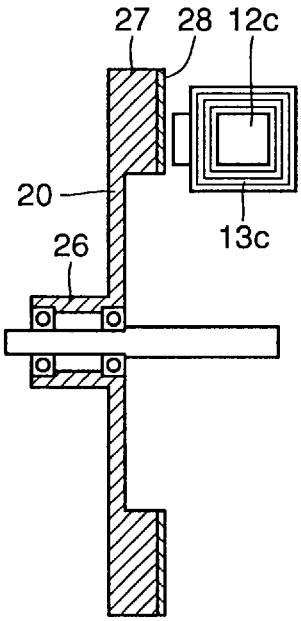
Figure 3B:
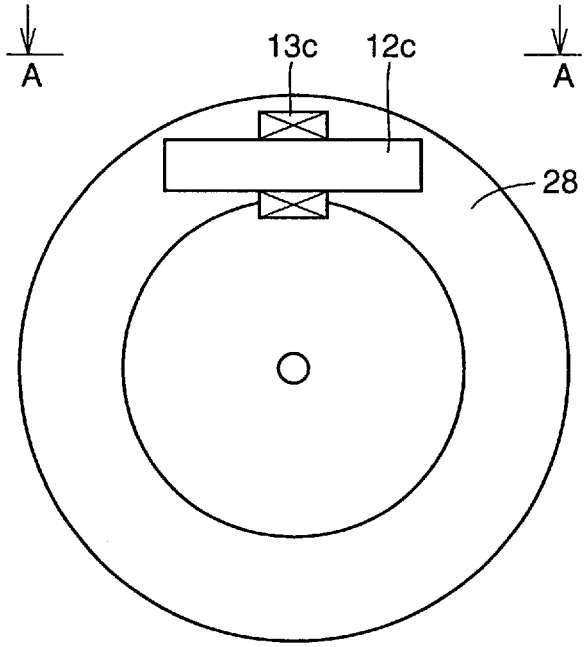

In the following, another embodiment of the ergometer loading device according to the present invention will be described. Referring to FIGS. 3A, 3B and 3C, a loading device includes a rotor 26 which is formed of a ferromagnetic body 27 and a conductor 28 and a stator 16 which is provided on a side surface of rotor 26. Stator 16 includes a core 12*c* which is provided spaced apart from conductor 28 by about 1 mm, and a coil 13*c*.

Gap adjustment in this case is one-sided adjustment from the side surface of rotor 26 and can be performed relatively easily.

Figure 7:
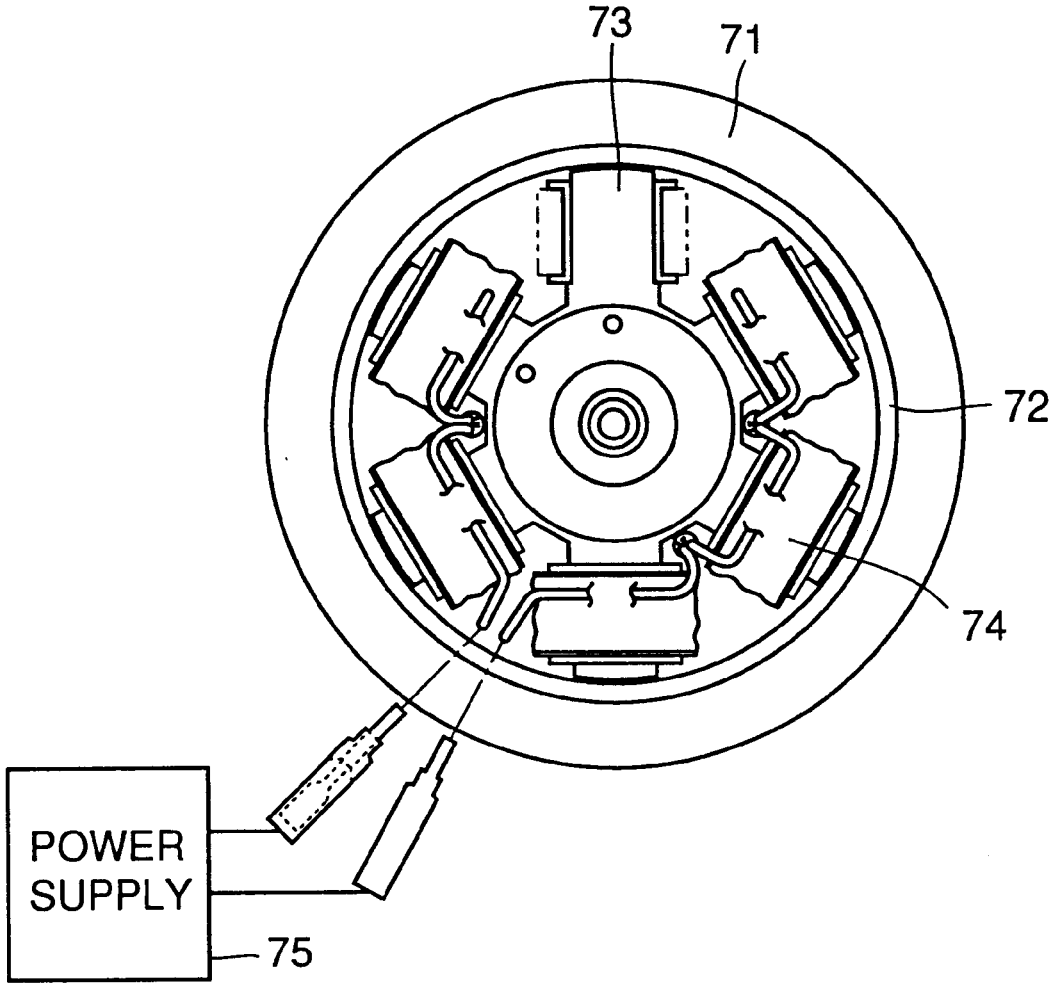
FIG. 7 PRIOR ART
FIG. 7 shows a structure of a conventional drum type loading device.

In the following, comparison between the braking torque of a crank shaft when copper plating is provided as. in the present invention and that when copper plating is not provided as shown in FIG. 7 will be shown in Table 1.

TABLE 1

Unit: Nm

| Thickness of Cu plating (mm) | Gap (mm) | Coil current value (mA) | Number of coil turns | Test symbol | Speed of drum rotation (rpm) 480 | 960 | 1440 | 1920 | 2400 |
|---|---|---|---|---|---|---|---|---|---|
| Cu 0.02 | 1.0 | 550 | 1500 | T1-1 | 21.66 | 33.12 | 39.98 | 44.00 | 46.06 |
| Cu 0.02 | 1.0 | 450 | 1500 | T1-2 | 19.50 | 29.11 | 34.30 | 37.24 | 39.00 |
| Cu 0.02 | 1.0 | 300 | 1500 | T1-3 | 15.68 | 21.17 | 23.72 | 24.99 | 25.68 |
| Cu — | 1.0 | 550 | 1500 | T0-1 | 20.68 | 30.67 | 36.75 | 40.38 | 42.14 |
| Cu — | 1.0 | 450 | 1500 | T0-2 | 18.82 | 26.85 | 31.26 | 34.01 | 35.18 |
| Cu — | 1.0 | 300 | 1500 | T0-3 | 13.62 | 17.93 | 20.09 | 21.17 | 21.66 |

Referring to Table 1, the coil current value is changed at three stages for each of the cases where copper plating is provided and where copper plating is not provided, and the speed of rotor (drum) rotation is changed at five stages of 480, 960, 1440, 1920 and 2400 rpm for each case.

Figure 4:
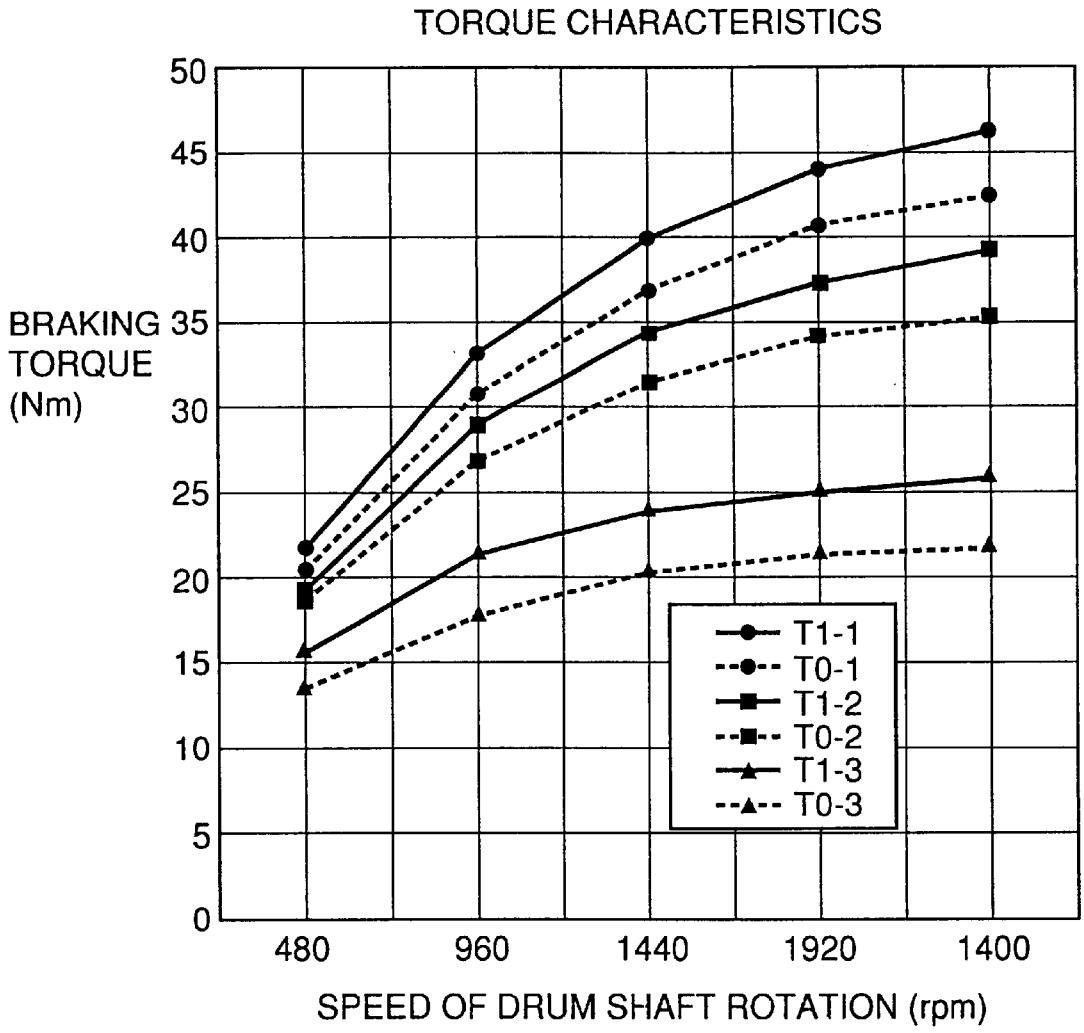
FIG. 4 shows the change rate of braking torque due to the presence/absence of copper plating.

The graph of the above data is shown in FIG. 4. In FIG. 4, the solid line indicates the case where copper plating is provided as in the present invention, and the dash line indicates the case where copper plating is not provided. As is apparent from Table 1 and FIG. 4, the generated braking torque is larger, regardless of the speed of drum shaft rotation, in each case where copper plating is provided than the cases where copper plating is not provided.

It can be seen that the effects become higher as the speed of drum shaft rotation increases. As described above, according to the present invention, the generated braking torque can be made larger than when a conductor is not provided, by using a steel plate which has a carbon content of 0.15% or less and applying copper plating to the conductor.

In the following, the magnitude change of the crank shaft braking torque with respect to the speed of rotor rotation when the gap between the rotor and the stator is changed will be shown in Table 2 and FIG. 5.

TABLE 2

Unit: Nm

| Copper plate thickness mm | Gap mm | Current mA | Number of coil turns | Symbol/ rpm | 480 | 960 | 1440 | 1920 | 2400 |
|---|---|---|---|---|---|---|---|---|---|
| 0.020 | 0.48 | 450 | 1500 | T1-2 | 19.5 | 29.1 | 34.3 | 37.2 | 39.0 |
| 0.060 | 0.46 | 450 | 1500 | T58-4 | 23.2 | 36.0 | 43.0 | 46.3 | 47.6 |
| 0.150 | 0.53 | 450 | 1500 | T15-3 | 27.6 | 42.8 | 48.9 | 50.7 | 50.5 |
| 0.800 | 1.70 | 640 | 1700 | EC-1000 | 32.4 | 35.8 | 37.8 | 37.6 | 36.2 |

Figure 6:
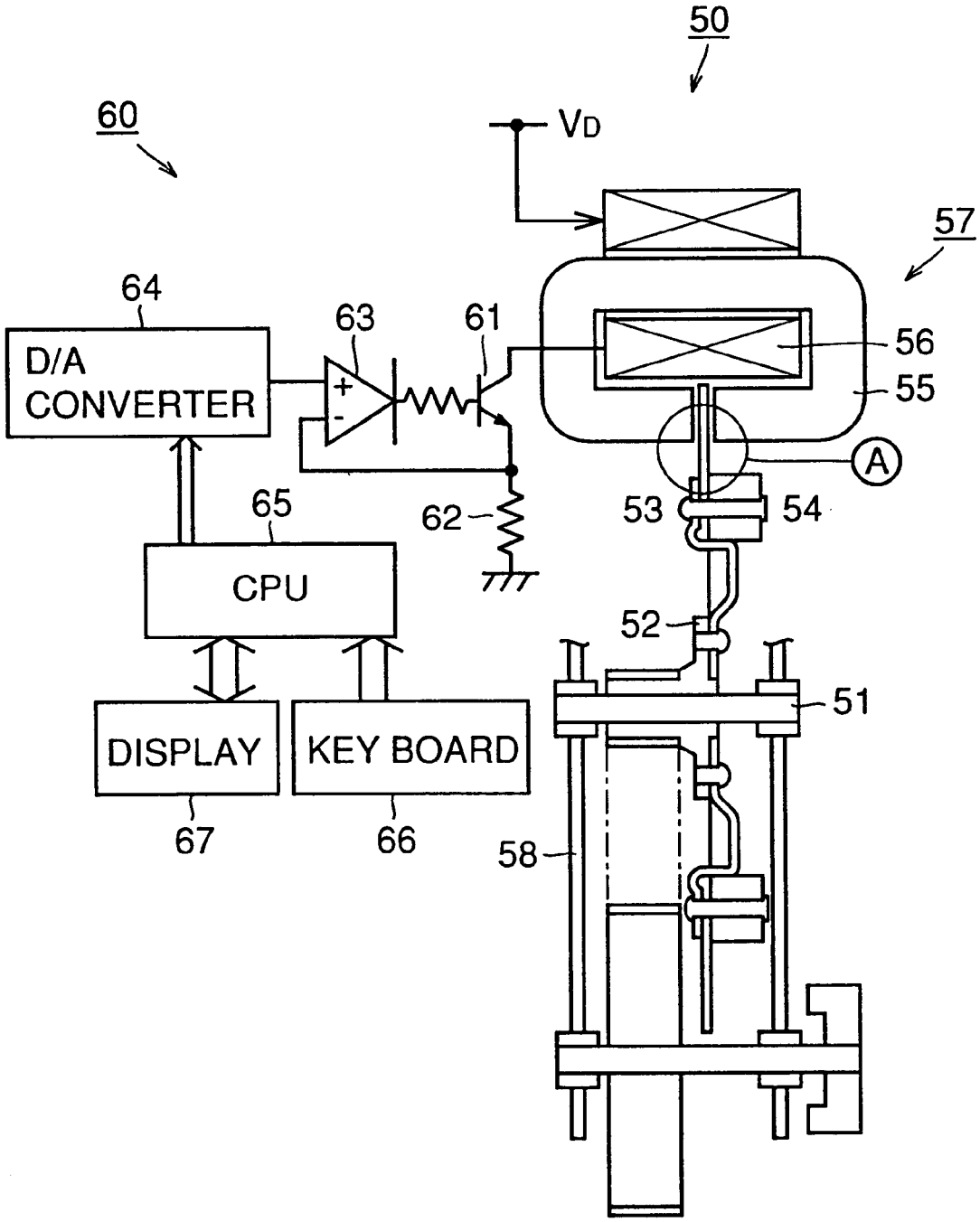
FIG. 6 PRIOR ART
FIG. 6 shows a structure of an ergometer loading device in a conventional C-shaped core structure loading device.

Referring to Table 2, the gap values when the thickness of the copper plate is changed to 0.02 mm, 0.06 mm, 0.15 mm and 0.80 mm, the current values, the numbers of coil turns, and the braking torque values for each number of rotation are shown. It is noted that the data which corresponds to the copper plate thickness of 0.8 mm and the gap of 1.7 mm are that of the conventional loading device shown in FIG. 6.

Figure 5:
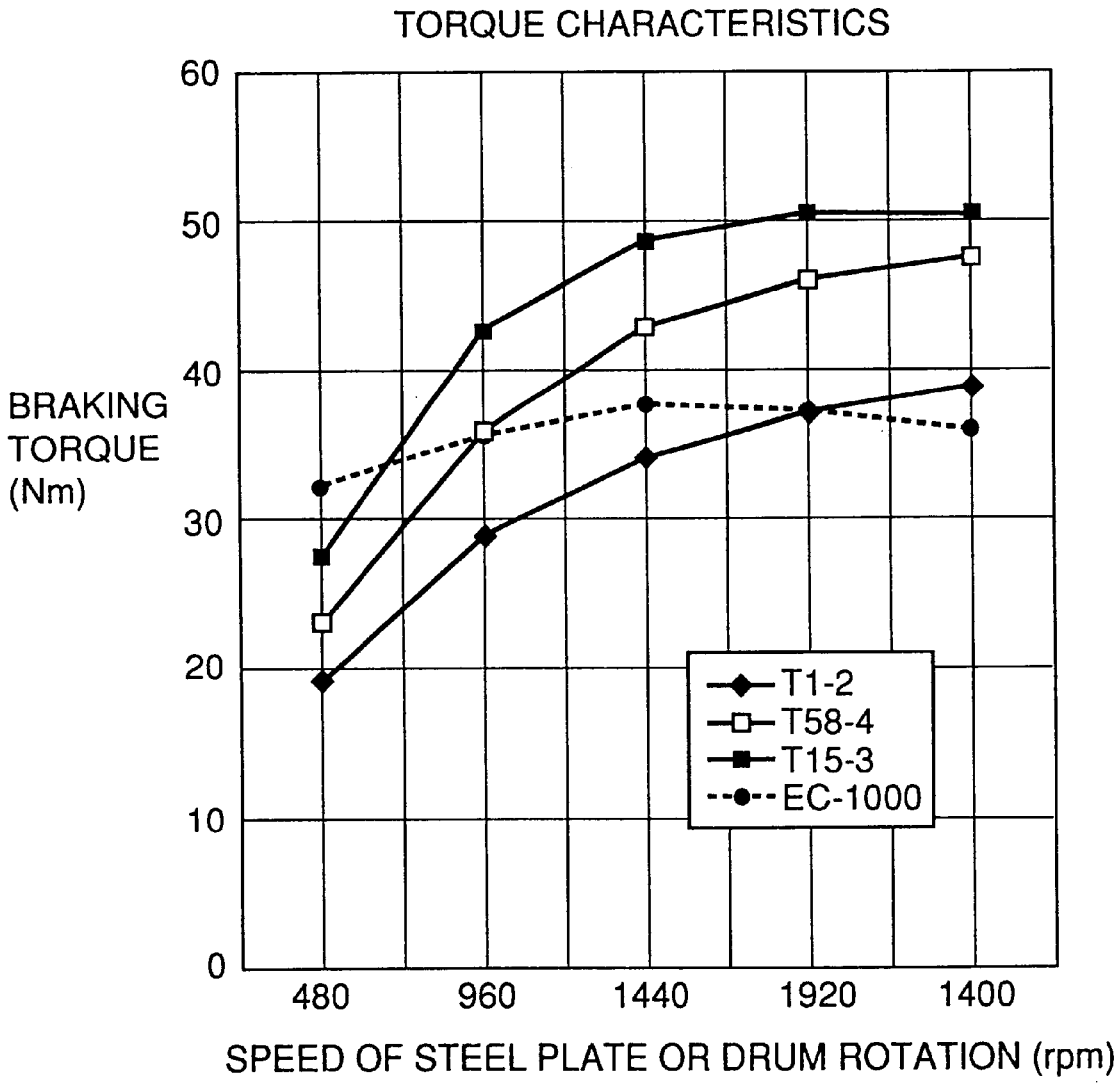
FIG. 5 shows the change rate of braking torque according to the thickness of copper plating.

FIG. 5 shows the change of the braking torque with respect to the speed of copper plate or drum rotation based on the data of Table 2. In FIG. 5, the magnitude of the braking torque for the rotational speed of the conventional copper plate is shown by the dash line.

Referring to Table 2 and FIG. 5, the braking torque increases as the speed of drum rotation becomes larger in the present invention. The magnitude is larger as the copper plate has a larger thickness.

In FIG. 4, the solid line corresponds to the case of 20 $\mu$m copper plating provided on the inner diameter surface of a drum, and the dash line corresponds to the case without copper plating. Furthermore, the marks ○ , □ and Δ denote the values when currents of 550, 450 and 300 mA are supplied to an electromagnetic coil. It can be seen that there is a difference of about 9% on average for the speeds of drum rotation of 960 to 2400 rpm.

In the embodiments, copper plating is employed as a thin material of small electric resistance. However, this is not always the case and other conductive materials such as aluminum can be used.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ergometer loading device, comprising a rotor formed of a steel plate and rotatable about a prescribed shaft, said rotor having a first circumferential surface apart from said prescribed shaft by at least a prescribed distance, a second circumferential surface formed of a member having small electrical resistance being formed on said first circumferential surface; said second circumferential surface having a prescribed thickness and said prescribed thickness being about 0.01 to 0.10 mm; and a stator coaxial with said rotor, and having a third circumferential surface that faces said second circumferential surface of said rotor with a prescribed gap therebetween.

2. An ergometer loading device according to claim 1, wherein said second circumferential surface is formed from copper.

3. For use in an ergometer loading device including a rotor, a stator cooperating with the rotor and magnetic excitation means cooperating with said stator, the improvement comprising:

the rotor being formed of a steel plate and being rotatable about a prescribed shaft, said rotor having a first circumferential surface apart from said prescribed shaft by at least a prescribed distance, a second circumferential surface formed of a member having small electrical resistance being formed on said first circumferential surface; said second circumferential surface having a prescribed thickness and said prescribed thickness being about 0.01 to 0.10 mm; and the stator being coaxial with said rotor, and having a third circumferential surface that faces said second circumferential surface of said rotor with a prescribed gap therebetween, said stator including a plurality of exciting coils capable of being excited by the magnetic excitation means for providing braking force to said rotor.

4. An ergometer loading device according to claim 3, wherein said second circumferential surface is formed from copper.

* * * * *